US009415293B1

(12) United States Patent
Wang

(10) Patent No.: US 9,415,293 B1
(45) Date of Patent: Aug. 16, 2016

(54) PULL-UP FITNESS EXERCISE MACHINE

(71) Applicant: Leao Wang, Taichung (TW)

(72) Inventor: Leao Wang, Taichung (TW)

( * ) Notice: Subject to any disclaimer, the term of this patent is extended or adjusted under 35 U.S.C. 154(b) by 0 days.

(21) Appl. No.: 14/622,932

(22) Filed: Feb. 16, 2015

(51) Int. Cl.
*A63B 21/068* (2006.01)
*A63B 71/00* (2006.01)
*A63B 23/12* (2006.01)

(52) U.S. Cl.
CPC ..... *A63B 71/0054* (2013.01); *A63B 21/068* (2013.01); *A63B 21/4035* (2015.10); *A63B 23/1218* (2013.01)

(58) Field of Classification Search
CPC ..... A63B 21/068; A63B 21/4035; A63B 71/0054; A63B 23/1218; A63B 21/00058; A63B 21/00069; A63B 21/000178; A63B 21/00181; A63B 21/00185; A63B 21/4047; A63B 22/0002; A63B 22/0005; A63B 22/0048; A63B 2022/0094; A63B 23/0205; A63B 23/0211; A63B 23/035; A63B 23/12; A63B 23/1209; A63B 23/1227; A63B 23/1236; A63B 21/00178
See application file for complete search history.

(56) References Cited

U.S. PATENT DOCUMENTS 248,121 A * 10/1881 Tuttle ..... A63B 21/0615 482/96
3,128,094 A * 4/1964 Wolf ..... A63B 1/00 482/113
5,312,313 A * 5/1994 Holmes ..... A63B 21/00181 482/51
5,322,489 A * 6/1994 Webb ..... A63B 21/00181 482/100
5,499,959 A * 3/1996 Holmes ..... A63B 21/00181 482/135
5,540,639 A * 7/1996 Potts ..... A63B 21/00181 482/92
5,554,083 A * 9/1996 Chen ..... A63B 21/00181 482/138
7,789,812 B2 * 9/2010 Anderson ..... A63B 7/04 482/95
8,152,700 B2 * 4/2012 Adams ..... A63B 21/154 482/94
2007/0232464 A1 * 10/2007 Chu ..... A63B 21/00072 482/96
2013/0102443 A1 * 4/2013 Lundquist ..... A63B 21/068 482/93
2015/0217156 A1 * 8/2015 Meredith ..... A63B 21/062 482/38

* cited by examiner

*Primary Examiner* — Oren Ginsberg
*Assistant Examiner* — Megan Anderson

(57) ABSTRACT

A pull-up fitness exercise machine comprises a base for securing all components, an upright column fixed to the rear of the base, a top cantilever pivotally coupled to the top of upright column, a linking rope coupled to an end of the cantilever, and an elastic member driven by the other end of the linking rope for constantly pulling a rotary latching plate to rotate appropriately. A pull ring unit is installed at the other end of the cantilever and operated together with a pull string and a plurality of pulleys to provide an up and down displacement stroke for pulling the support plate. Moreover, a rotating rod assembly is pivotally coupled to the bottom of the upright column, and the other end of the rotating rod assembly is pivotally coupled to the support plate. An assisted pushing unit is interposed between the rotating rod assembly and the base and has an adjustable pushing force to provide an appropriate upward pushing force to the support plate. In addition, a linking hook lever is coaxially coupled to a first pivot point of the rotating rod assembly and configured to be corresponsive to a hook post of the rotary latching plate for constantly locking the rotating rod assembly and maintaining the support plate at a low static position. In this way, the pull ring unit can be pulled to perform an expected motion when the support plate bears a gravitational force, the cantilever is pulled downwardly, and the linking hook lever is released from a locked status relative to the rotary latching plate. When the external force of the pull ring unit disappears, the support plate is descended by the gravitational force to resume its original position and locked to a low static position automatically.

6 Claims, 11 Drawing Sheets

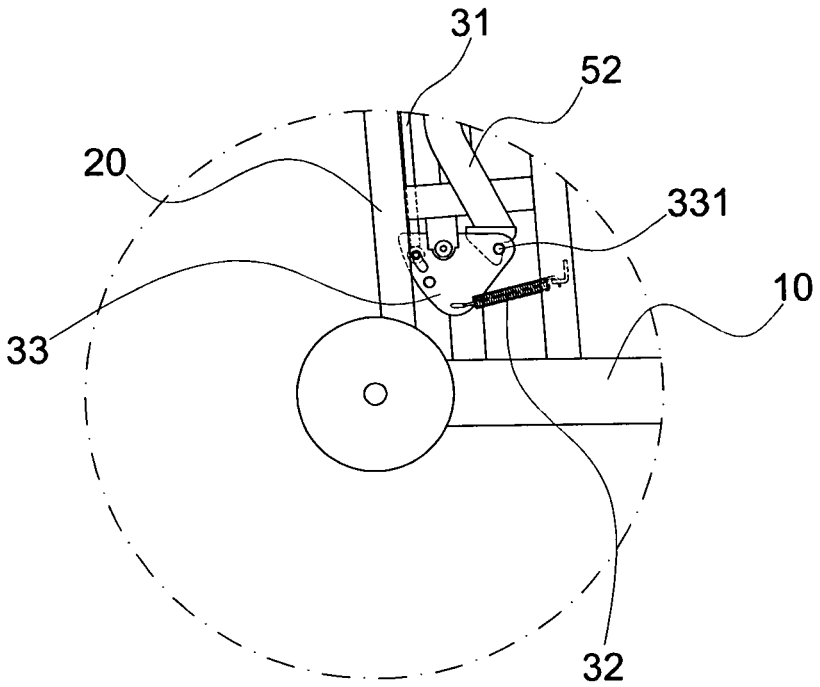
FIG.2-A

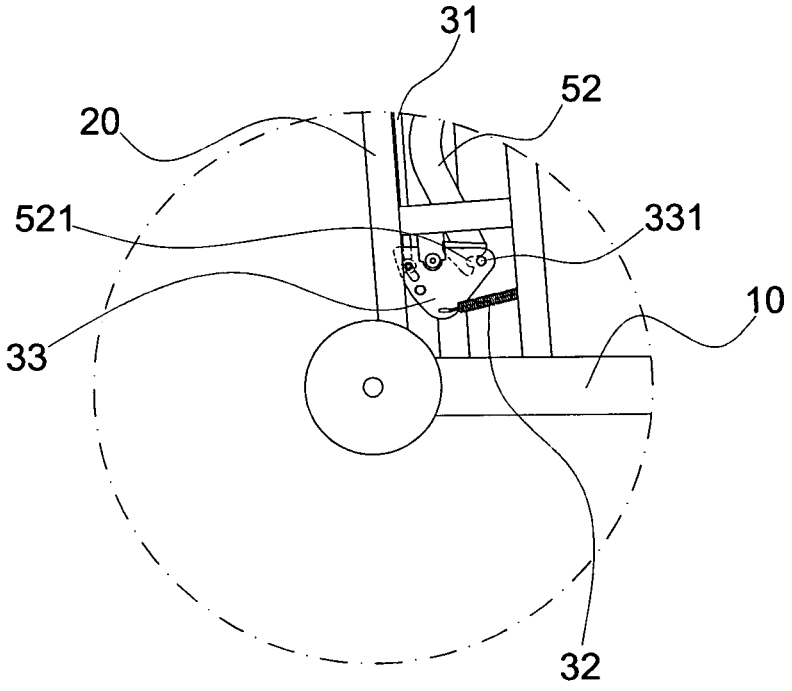
FIG.3-B

PULL-UP FITNESS EXERCISE MACHINE

BACKGROUND OF THE INVENTION

1. Field of the Invention

The present invention relates to the structure of a pull-up fitness exercise machine, and more particularly to the pull-up fitness exercise machine having a support plate always situated at a low static position during the beginning and the end of the use of the pull-up fitness exercise machine to facilitate users to step on to get on or step down to get off a support plate and carry out the expected exercise conveniently and safely.

2. Description of the Prior Art

Basically, a pull-up fitness exercise machine is an indoor exercise apparatus that simulates "High Bar" or "Rings". Of course, the pull-up fitness exercise machine may also be sued for various different types of limb exercises such as stretching the upper limbs or body building squats for the lower limbs, depending on the user's familiarity with the use of the machine and the user's personal exercise needs. Obviously, the pull-up fitness exercise machine is an excellent diversified indoor fitness apparatus; and most of the pull-up fitness exercise machines adopts the gravitational force of the whole of the user's body weight as the source of the load for the exercise, so that the design of the pull-up fitness exercise machines generally have an assisted pushing member (such as a spring pneumatic cylinder) installed at a position under the support plate to assist the user to apply forces, so as to avoid the situation that the user's physical strength is unable to bear the load of the user's body weight repeatedly. In other words, when we pull a pull ring unit installed at a top cantilever downwardly by both hands to lift the support plate situated at the bottom, the assisted pushing member will always provide an appropriately set upward pushing force to assist the user to apply forces in order to lift the user's body more easily.

Since the assisted pushing member always pushes the support plate, the support plate is generally situated at a position with a specific height (depending on the pushing length of the assisted pushing member) when the pull-up fitness exercise machine is not in use. When the user wants to use the pull-up fitness exercise machine, it is relatively inconvenient for the user to step on the support plate or the user is afraid of stepping on the support plate with a specific height from the ground. Of course, some of the conventional pull-up fitness exercise machines provide a stepwise platform disposed next to the lifted support plate to facilitate users to step on the support plate. However, such arrangement also makes the users psychologically scared of the expected ascending speed of the support plate, and to resist the use of such pull-up fitness exercise machine. Obviously, such mechanical design is hardly acceptable to users.

In addition, after the users finish with the exercise and want to leave the support plate, the users also have the same hesitation and fear, because once the user (with a body weight) leaves the support plate, the support plate will be pushed and lifted by the assisted pushing member immediately, so that the user have to be very careful while leaving the support plate. Occasionally, accidents or injuries caused by falling from exercise equipments of this sort occur, and the design of the conventional pull-up fitness exercise machines has a safety issue and definitely requires improvements.

SUMMARY OF THE INVENTION

It is a primary object of the present invention to provide a pull-up fitness exercise machine in which a top and down relation between a cantilever at the top and a support plate at the bottom together with a latch effect among a linking rope, a rotary latching plate, an elastic member and a linking hook lever are provided, and the support plate are always situated at a low static position at the beginning and at the end of the use of the fitness exercise machine, so that users may step up to get on or step down to get off the support plate easily to ensure the safety of use.

It is another object of the present invention to provide a pull-up fitness exercise machine having a height adjusting device installed at a top cantilever, an angle adjusting device installed at an angular crotch of a pull ring, and a pushing force adjusting device installed to an assisted pushing unit to fit users of different body types and physical strengths, so as to meet the using requirements and improve the overall practicality and convenience of the pull-up fitness exercise machine.

According to the invention, a pull-up fitness exercise machine comprises a base for securing all components, an upright column fixed to the rear of the base, a top cantilever pivotally coupled to the top of upright column, a linking rope coupled to an end of the cantilever, and an elastic member driven by the other end of the linking rope for constantly pulling a rotary latching plate to rotate appropriately. A pull ring unit is installed at the other end of the cantilever and operated together with a pull string and a plurality of pulleys to provide an up and down displacement stroke for pulling the support plate. Moreover, a rotating rod assembly is pivotally coupled to the bottom of the upright column, and the other end of the rotating rod assembly is pivotally coupled to the support plate. An assisted pushing unit is interposed between the rotating rod assembly and the base and has an adjustable pushing force to provide an appropriate upward pushing force to the support plate. In addition, a linking hook lever is coaxially coupled to a first pivot point of the rotating rod assembly and configured to be corresponsive to a hook post of the rotary latching plate for constantly locking the rotating rod assembly and maintaining the support plate at a low static position. In this way, the pull ring unit can be pulled to perform an expected motion when the support plate bears a gravitational force, the cantilever is pulled downwardly, and the linking hook lever is released from a locked status relative to the rotary latching plate. When the external force of the pull ring unit disappears, the support plate is descended by the gravitational force to resume its original position and locked to a low static position automatically.

BRIEF DESCRIPTION OF THE FIGURES

FIG. 2A is a partial blowup view of a portion indicated by the dotted circle of FIG. 2;

FIG. 3B is a partial blowup view of a portion indicated by the dotted circle of FIG. 3;

DETAILED DESCRIPTION OF THE PREFERRED EMBODIMENT

The technical measures and characteristics of the present invention will become clearer in light of the following detailed description of an illustrative embodiment of this invention described in connection with the drawings.

Figure 1:
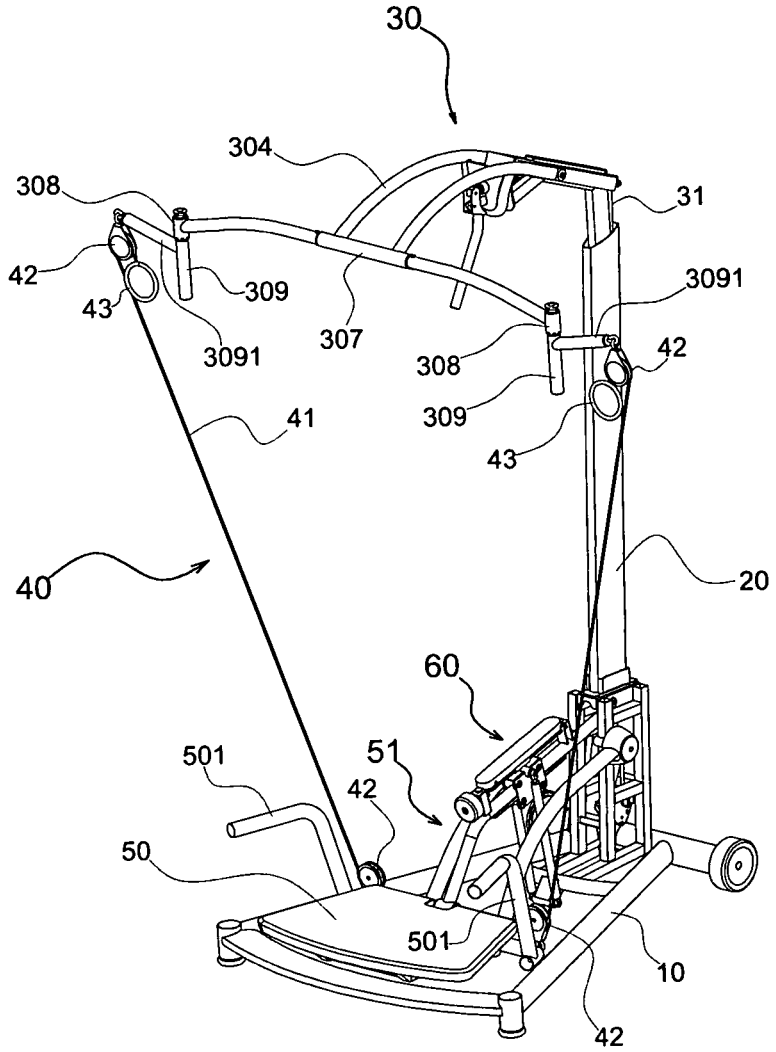
FIG. 1 is a perspective view of a pull-up fitness exercise machine in accordance with a preferred embodiment of the present invention.
Figure 2:
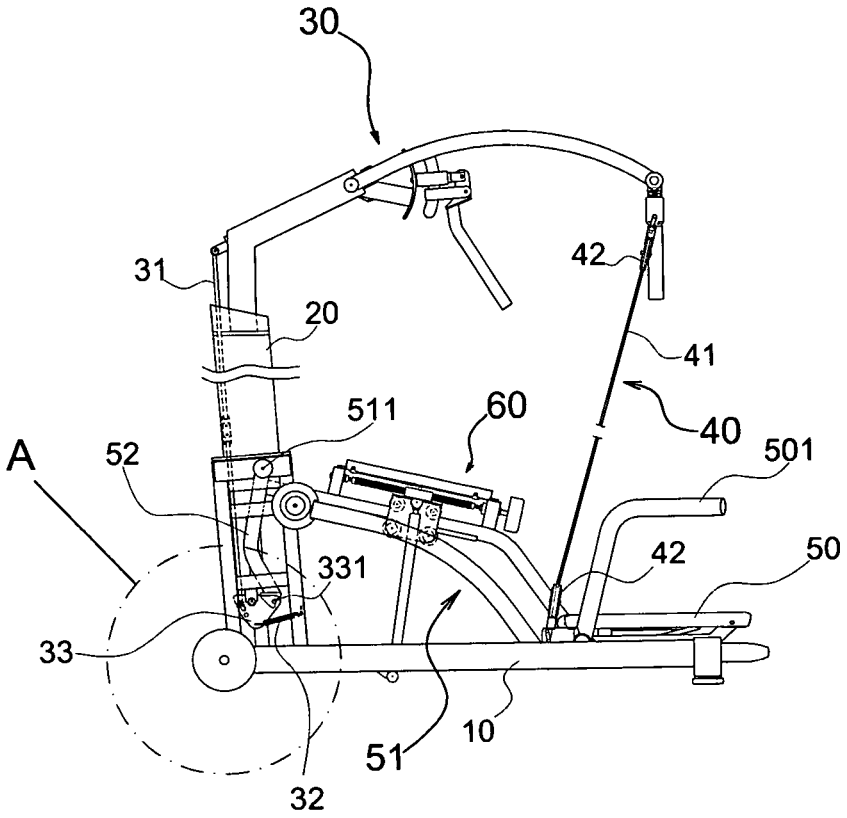
FIG. 2 is a schematic planar view of a pull-up fitness exercise machine having a linking hook lever situated at a locked status in accordance with the present invention.
Figure 3:
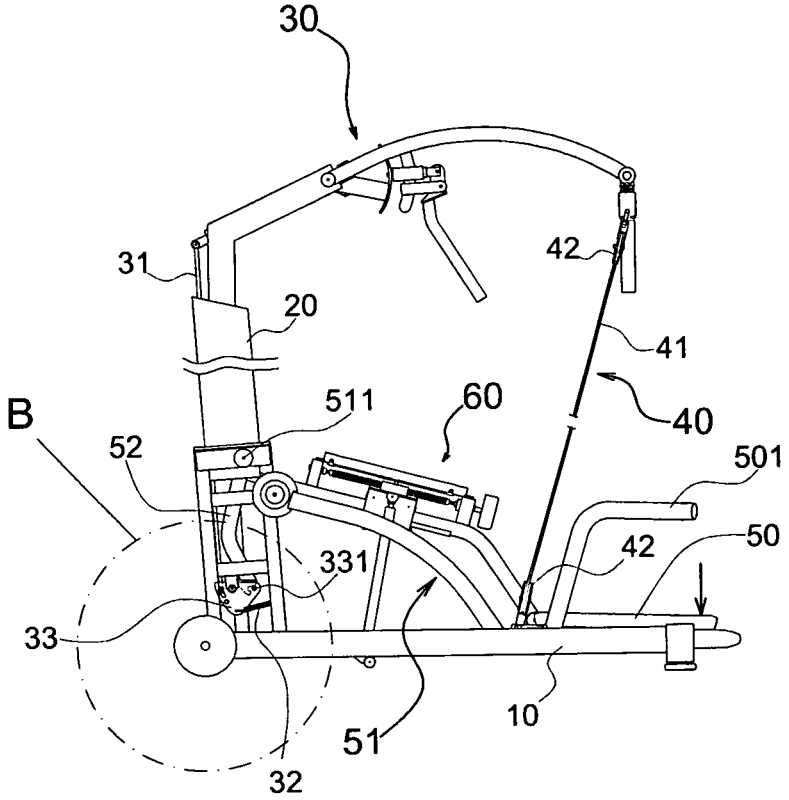
FIG. 3 is a schematic view showing the position of a pull-up fitness exercise machine with a support plate being pressed, so that a latch opening of a linking hook lever is separated from a corresponding hook post.
Figure 4:
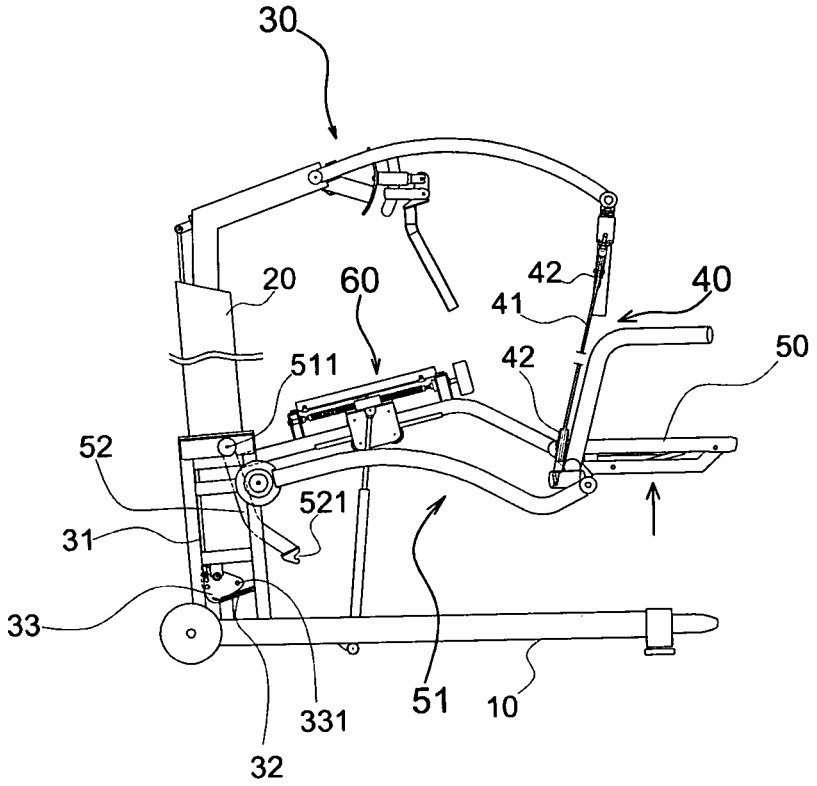
FIG. 4 is a schematic planar view of a linking hook lever situated at an unlocked status in accordance with the present invention.
Figure 5:
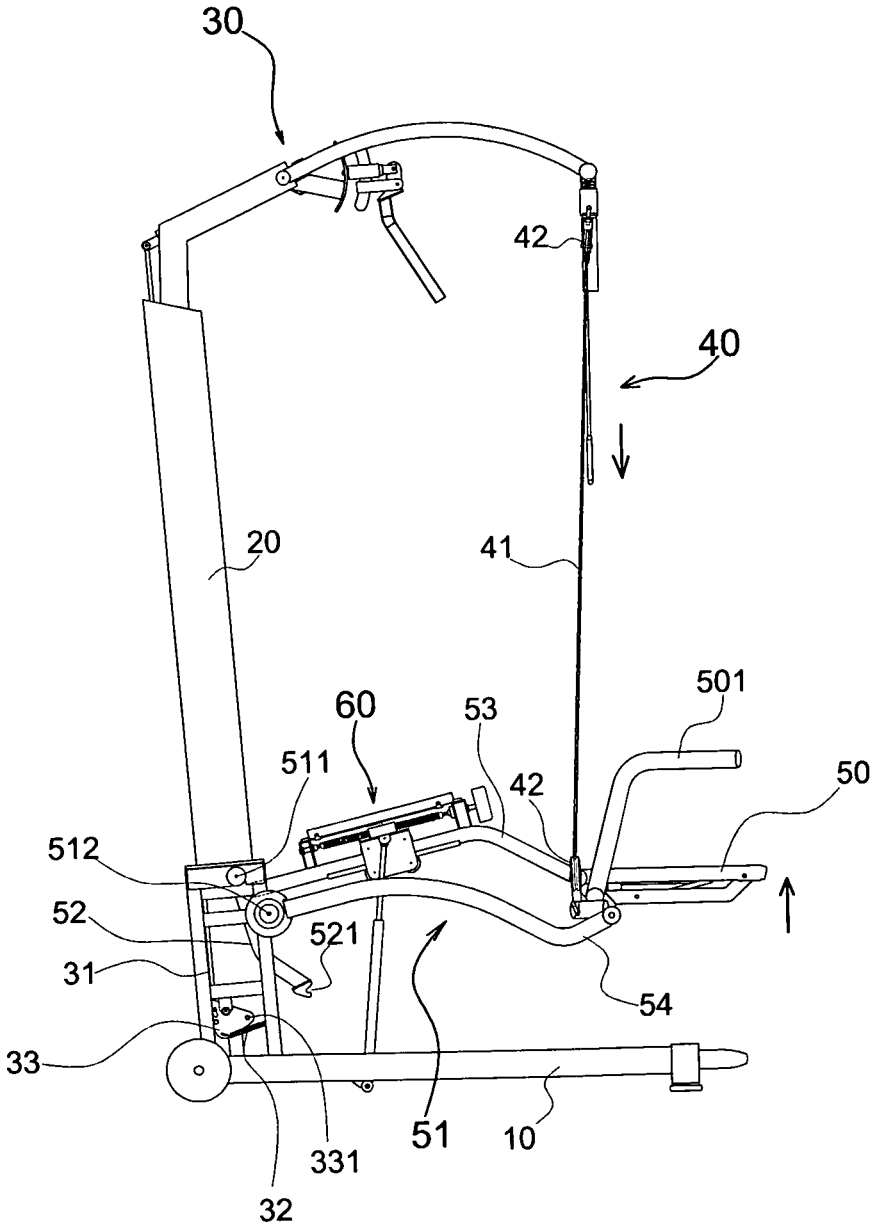
FIG. 5 is a schematic view of an operating status of the present invention.

With reference to FIGS. 1 to 5 for a pull-up fitness exercise machine in accordance with a preferred embodiment of the present invention, the pull-up fitness exercise machine comprises a base 10 for securing all components, an upright column 20 fixed to the rear of the base 10, a top cantilever 30 pivotally coupled to the top of the upright column 20, a linking rope 31 coupled to an end of the cantilever 30, and an elastic member 32 driven by the other end of the linking rope 31 for constantly pulling a rotary latching plate 33 to rotate appropriately. A pull ring unit 40 is installed at the other end of the cantilever 30 and operated together with a pull string 41 and a plurality of pulleys 42 to provide an up and down displacement stroke for pulling the support plate 50 (as shown in FIG. 5). Moreover, a rotating rod assembly 51 pivotally coupled to the bottom of the upright column 20, and the other end of the rotating rod assembly 51 is pivotally coupled to the support plate 50. An assisted pushing unit 60 is installed between the rotating rod assembly 51 and the base 10 and has an adjustable pushing force to provide an appropriate upward pushing force to the support plate 50. In addition, a linking hook lever 52 is coaxially coupled to a first pivot point 511 of the rotating rod assembly 51 and configured to be corresponsive to a hook post 331 of the rotary latching plate 33 for constantly locking the rotating rod assembly 51 and maintaining a low static position of the support plate 50 at a low static position. In this way, the pull ring unit can be pulled to perform an expected motion (as shown in FIG. 4) when the support plate bears a gravitational force (as shown in FIGS. 3 and 3B), the cantilever is pulled downwardly, and the linking hook lever is released from a locked status relative to the rotary latching plate. When the external force of the pull ring unit disappears, the support plate is descended by the gravitational force to resume its original position and locked to a low static position automatically.

In other words, after a user (not shown in the figure) finishes the exercise with the pull-up fitness exercise machine, and before the user leaves the support plate 50, the user's body weight naturally drives the support plate 50 to descend slowly. Since the user has released the force applied to the pull ring unit 40, therefore the elastic member 32 will pull the rotary latching plate 33 to its original latch position, and a latch opening 521 of the linking hook lever 52 is aligned precisely to the hook post 331. Now, the user may leave the support plate 50 at ease without worrying an accidental lift (that resumes the original latch position automatically as shown in FIG. 2), and the low static position is very convenient for the next user to get onto the support plate 50.

In FIG. 5, the rotating rod assembly 51 includes a central support lever 53 and two side rods 54, and whose open end is provided for pivotally coupling the support plate 50, wherein the other end of the central support lever 53 has a linking hook lever 52 coaxially installed to a first pivot point 511 of the upright column 20 to form a linking relation, and the two side rods 54 are respectively and pivotally coupled to a second pivot point 512 of the upright column 20.

Figure 6:
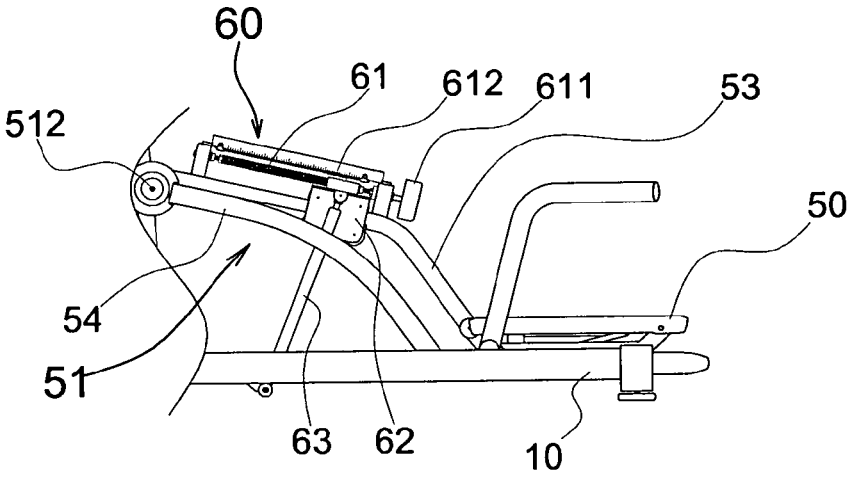
FIG. 6 is a schematic view of adjusting an assisted pushing unit of another preferred embodiment of the present invention.

In FIG. 6, the assisted pushing unit 60 includes a screw adjusting member 61 installed to the central support lever 53, a slide base 62 adjustably moved by the screw adjusting member 61, and a spring pneumatic cylinder 63 pivotally coupled to the slide base 62, such that a knob 611 installed to a side of the screw adjusting member 61 may be turned to adjust the assisted pushing force of the spring pneumatic cylinder 63. In other words, the closer the spring pneumatic cylinder 63 to the support plate 50, the greater the pushing force, and vice versa. Of course, a calibration table 612 may be drawn at an appropriate position of the screw adjusting member 61, so that the user may control the pushing force more easily.

Figure 8:
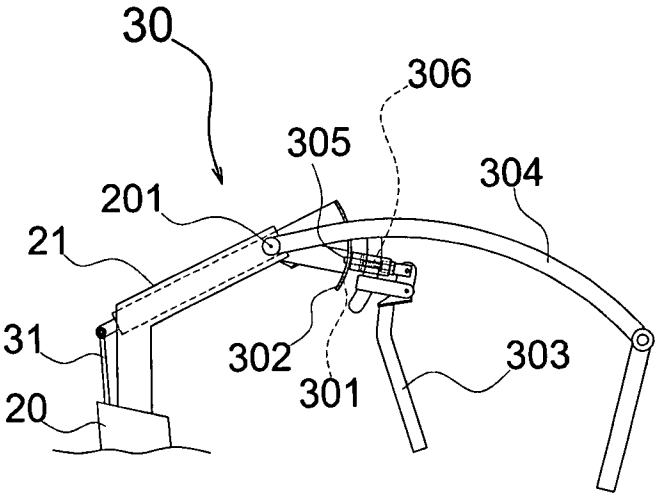
FIG. 8 is a schematic view of a series of adjustments as depicted in a part of FIG. 7.
Figure 7:
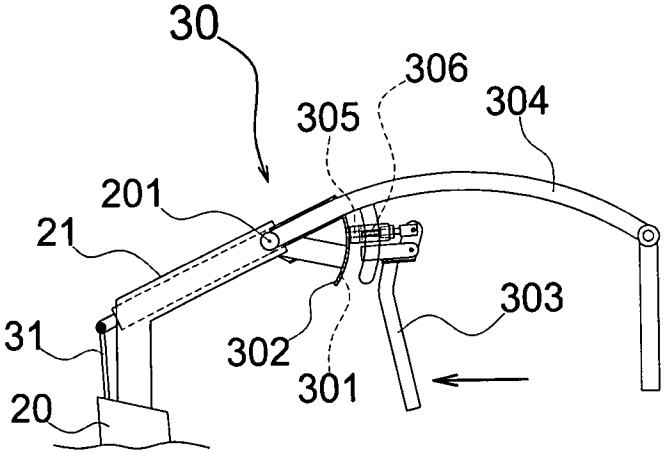
FIG. 7 is a schematic view of adjusting the height and angle of a top cantilever of the present invention.
Figure 11:
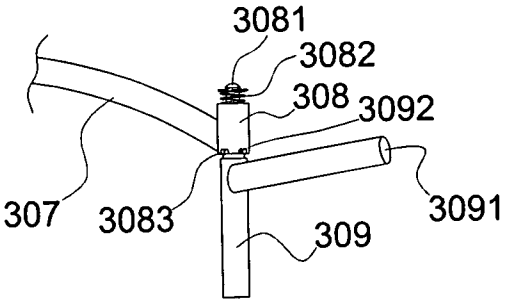
FIG. 11 is a schematic view of a series of adjustments as depicted in a part of FIG. 10.

In FIGS. 7 and 8, the rear of the cantilever 30 is plugged into a hollow section 21 at the top of the upright column 20, and then a shaft connecting element 201 is provided for pivotally coupling the cantilever 30 and the upright column 20, and the front of the cantilever 30 is fixed to an arc plate 302 having a plurality of selective slots 301, and an extended wishbone 304 having a spring pulling lever 303 is provided for adjusting high and low positions of the extended wishbone 304, and the extended wishbone 304 is also pivotally coupled to an external side of the hollow section 21 by a shaft connecting element 201, so that an insert shaft 305 of the spring pulling lever 303 disposed at the central position is plugged into any one of the selective slots 301 of the arc plate 302. When the spring pulling lever 303 is pulled, the insert shaft 305 leaves the original selective slot 301 (as shown in FIG. 7), and users may select the desired height and angle. After the pressure exerted to the spring pulling lever 303 is released, the elastic member 306 installed in the spring pulling lever 303 will drive the insert shaft 305 to be plugged and positioned into the desired selective slot 301.

From the aforementioned design, the cantilever 30 is limited by the space of the hollow section 21, so that the cantilever 30 just may use the shaft connecting element 201 as a rotating axis and can be rotated within a limited angle, and such limited rotating angle can turn the rotary latching plate 33 to reach an unlocked status of the whole mechanism.

Figure 10:
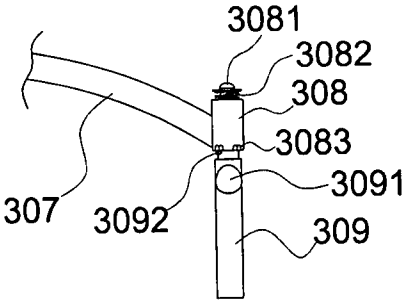
FIG. 10 is a schematic view of adjusting an angular crotch as depicted in FIG. 9.
Figure 9:
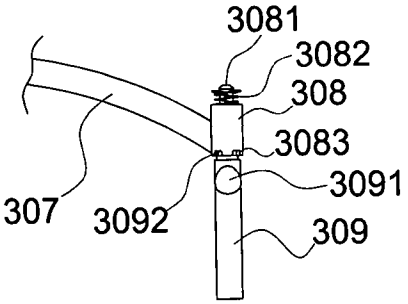
FIG. 9 is a schematic view of a part of an angular crotch of the present invention.

In FIGS. 1, 9, 10, and 11, the front of the extended wishbone 304 is a crossframe 307, and both ends of the crossframe 307 have a bushing 308 with a plurality of limit notches 3083, and each bushing 308 has a positioning pivot 3081 and an elastic member 3082 and pivotally coupled to an angular crotch 309, and a branching section 3091 of the angular crotch 309 is coupled to a pull ring unit 40, so that when the angular crotch 309 is pulled downwardly, a latching bump 3092 of the angular crotch 309 leaves the original limit notch 3083 of the bushing 308 (as shown in FIG. 10), and the angular crotch 309 can be rotated to the desired angle and then released, and the elastic member 3082 will latch bushing 308 and the angular crotch 309 at the required angle and position automatically.

The pull ring unit 40 includes a pull string 41, four pulleys 42 and two pull rings 43, wherein two sets of pulleys 42 are pivotally coupled to an end of the branching section 3091 of the two angular crotches 309, and the other two sets of pulleys 42 are respectively and pivotally coupled to both sides of the rear of the support plate 50, and the pull ring 43 is fixed to both ends of the pull string 41, so that when the support plate 50 is released, a user may pull any one of the pull rings 43 or both of the two pull rings 43 in order to pull the support plate 50 to move up and down.

Figure 12:
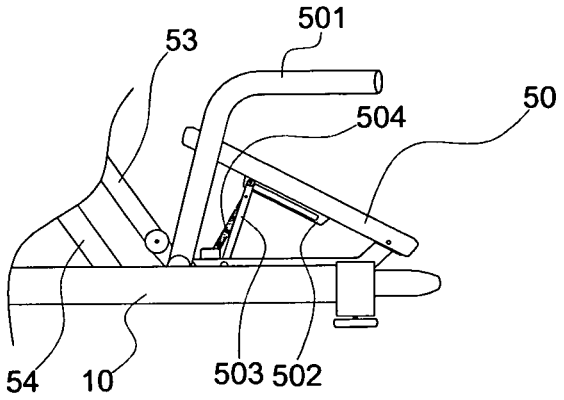
FIG. 12 is a schematic view of adjusting an angle of a support plate of the present invention.

In FIG. 12, two handrails 501 are installed on both sides of the support plate 50 respectively, and a skid plate 502 is installed at the bottom of the support plate 50, and operated together with a jack 503 and an elastic member 504 to lift the support plate 50 to a tilt angle. When a user is performing a squat movement, the user has to sit on the support plate 50 with the user's back facing the fitness machine, so that the fitness machine not just assists the user's squat movement only, but also provides a reliable and safe grip for stabilizing the user's body appropriately to prevent accidents such as falling or being injured.

Figure 13:
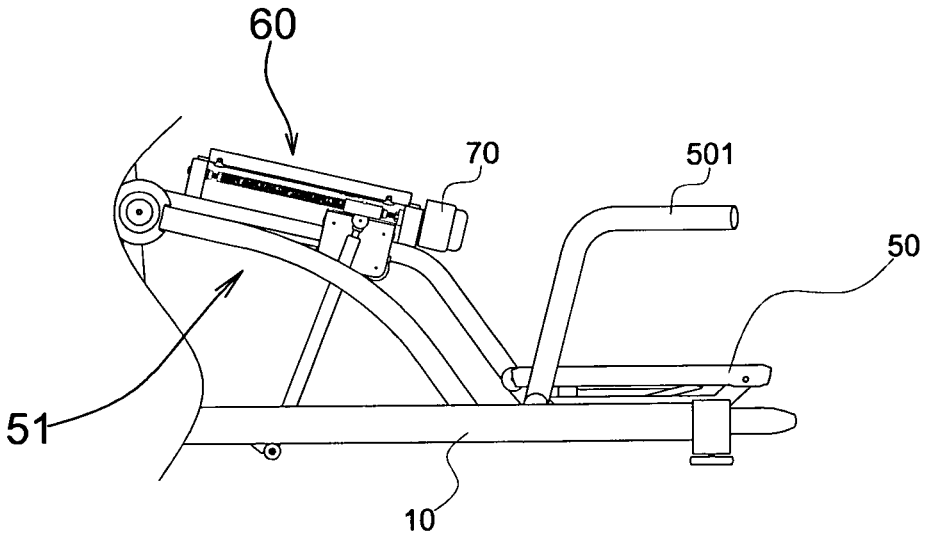
FIG. 13 is a schematic view of an assisted pushing unit in accordance with another preferred embodiment of the present invention.

In FIG. 13, the present invention may use an electric motor 70 to substitute the knob 611 in order to adjust the pushing force of the spring pneumatic cylinder 63 more quickly.

For simplicity, the key elements are represented by respective numerals in the drawings and provided for illustrating the technical characteristics of the present invention but not intended for limiting the scope of the invention.

In summation of the description above, the present invention complies with the patent application requirements, and thus is duly filed for patent application.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A pull-up fitness exercise machine, comprising a base for securing all components, an upright column fixed to the rear of the base, a top cantilever pivotally coupled to the top of upright column, a linking rope coupled to an end of the cantilever, and an elastic member driven by the other end of the linking rope for constantly pulling a rotary latching plate to rotate appropriately, a pull ring unit installed at the other end of the cantilever and operated together with a pull string and a plurality of pulleys to provide an up and down displacement stroke for pulling the support plate, a rotating rod assembly pivotally coupled to the bottom of the upright column, and the other end of the rotating rod assembly being pivotally coupled to the support plate, an assisted pushing unit installed between the rotating rod assembly and the base and having an adjustable pushing force to provide an appropriate upward pushing force to the support plate, and a linking hook lever coaxially coupled to a first pivot point of the rotating rod assembly and configured to be corresponsive to a hook post of the rotary latching plate for constantly locking the rotating rod assembly and maintaining the support plate at a low static position, wherein the pull ring unit can be pulled to perform an expected motion when the support plate bears a gravitational force, the cantilever is pulled downwardly, and the linking hook lever is released from a locked status relative to the rotary latching plate; and wherein, when the external force of the pull ring unit disappears, the support plate is descended by the gravitational force to resume its original position and locked to a low static position automatically.

2. The pull-up fitness exercise machine of claim 1, wherein the rotating rod assembly includes a central support lever and two side rods and wherein a linking hook lever is installed at the other end of the central support lever, and coaxially installed at a first pivot point of the upright column to form a linking relation, and wherein the two side rods are respectively and pivotally coupled to a second pivot point of the upright column.

3. The pull-up fitness exercise machine of claim 1, wherein the assisted pushing unit includes a screw adjusting member installed to the central support lever and having a knob, a slide base adjustably moved by the screw adjusting member, and a spring pneumatic cylinder pivotally coupled to the slide base.

4. The pull-up fitness exercise machine of claim 1, wherein the rear of the cantilever is plugged into a hollow section of the top of the upright column, and a shaft connecting element is provided for pivotally coupling the cantilever and the upright column, and the front of the cantilever is fixed to an arc plate having a plurality of selective slots, and an extended wishbone having a spring pulling lever is provided for adjusting high and low positions of the extended wishbone, and the extended wishbone is also pivotally coupled to an external side of the hollow section by a shaft connecting element, and an insert shaft of the spring pulling lever is plugged into any one of the selective slots of the arc plate, and the front of the extended wishbone is a crossframe having a bushing with a plurality of limit notches and mounted to both ends of the crossframe, and a positioning pivot and an elastic member are provided for pivotally coupling an angular crotch having a latching bump, and a branching section of the angular crotch is coupled to a pull ring unit.

5. The pull-up fitness exercise machine of claim 1, wherein the support plate further includes a handrail installed separately on both sides of the support plate, and a skid plate installed at the bottom of the support plate, and operated with a jack and an elastic member to lift the support plate to an appropriate tilt angle.

6. The pull-up fitness exercise machine of claim 1, wherein the assisted pushing unit includes a screw adjusting member installed to the central support lever and having an electric motor, a slide base adjustably moved by the screw adjusting member, and a spring pneumatic cylinder pivotally coupled to the slide base.

* * * * *